United States Patent [19]

Radtke et al.

[11] Patent Number: 4,499,958

[45] Date of Patent: Feb. 19, 1985

[54] DRAG BLADE BIT WITH DIAMOND CUTTING ELEMENTS

[75] Inventors: Robert P. Radtke, Kingwood; Wilford V. Morris, Houston, both of Tex.

[73] Assignee: Strata Bit Corporation, Houston, Tex.

[21] Appl. No.: 489,934

[22] Filed: Apr. 29, 1983

[51] Int. Cl.[3] ..... E21B 10/46

[52] U.S. Cl. ..... 175/329; 175/410; 175/413

[58] Field of Search ..... 175/410, 409, 412, 413, 175/329, 422, 411

[56] References Cited

U.S. PATENT DOCUMENTS

| | | | |
|---|---|---|---|
| 2,867,413 | 1/1959 | Olsen | 175/410 |
| 2,978,049 | 4/1961 | Skidmore et al. | 175/413 |
| 3,645,346 | 2/1972 | Miller et al. | 175/393 |
| 3,760,844 | 9/1973 | Pitifer | 175/413 |
| 4,246,977 | 1/1981 | Allen | 175/410 |
| 4,350,215 | 9/1982 | Radtke | 175/410 |

OTHER PUBLICATIONS

Servco Tungsten Carbide Hardfacing Material brochure, May 1, 1979, (copyright, 1978).

*Primary Examiner*—Stephen J. Novosad
*Assistant Examiner*—Mark J. DelSignore
*Attorney, Agent, or Firm*—Burns, Doane, Swecker & Mathis

[57] ABSTRACT

A drag blade bit for connection on a drill string has a hollow body on which there are welded a plurality of cutting or drilling blades. The blades extend longitudinally and radially of the bit body and terminate in relatively flat, radially extending cutting edges. A plurality of cutters are positioned in and spaced along the cutting edges and consists of cylindrical sintered carbide inserts with polycrystalline diamond cutting elements mounted thereon. Hardfacing is provided on the cutting edges between the cutters and on the other surfaces of the blades and the bit body subject to abrasive wear. One or more nozzles are positioned in passages from the interior of the bit body for directing flow of drilling fluid for flushing cuttings from the well bore and for cooling the bit.

15 Claims, 11 Drawing Figures

DRAG BLADE BIT WITH DIAMOND CUTTING ELEMENTS

BACKGROUND OF THE INVENTION

1. Field of the Invention

This invention relates to new and useful improvements in drag blade bits and more particularly to drag blade bits having diamond cutters along the cutting edges thereof.

2. Description of the Prior Art

Drilling tools or bits for drilling holes in the ground have been known since prehistoric times. There is evidence, as far back as 30,000 years ago, of the use of wooden drills for working in stone and shells. Tools for digging wells, such as picks, bars, shovels, etc. have been in use since antiquity. The earliest mechanically operated percussion drills were used by the Chinese about a thousand years ago. Rotary drilling tools for boring holes were used in stone quarries of Egypt from the time of the construction of the Pyramids.

The development of drill bits for oil well drilling dates from the 1860s. Von Ringharz U.S. Pat. No. 228,780 discloses a rotary drag bit used in drilling artesian and other wells. That patent also describes the use of the circulation of water through a drill string for flushing cuttings from the bore hole.

Rotary blade bits, and particularly fish tail bits, were used extensively during the early days of oil well drilling. Rotary blade type drag bits were used primarily for drilling through shale and other soft formations. The rotary blade bits were also useful in clay and gumbo type formations. These bits were capable of drilling at a fairly high speed but would wear out in a relatively short distance. It was not unusual for a rotary drag bit to wear out in 75' to 100' of drilling. Also, whenever harder formations were encountered, the drag bits would not drill satisfactorily.

In the History of Oil Well Drilling, J. E. Brantly, Gulf Publishing Company, 1971, Chapter 21 "Rotary Bits" describes in detail the history of development of drill bits for oil well drilling. Numerous examples are given of the early drag bits which were used for shallow wells and particularly for drilling through soft formations. The rotary drag bits or blade bits were largely replaced in later years by roller cone bits and other bits capable of drilling through harder, rock formations. The rotary blade bits, however, have continued in use to the present day and are used still for drilling through shale and other soft formations.

Because of the fact that rotary blade bits wear out rapidly in use, there were numerous attempts made to increase the wear life of those bits. As early as 1923, tungsten carbide was used as a diamond substitute in core drilling. The high expense of tungsten carbide restricted its use to core bits until cheaper methods of manufacture were discovered. As a cheaper tungsten carbide became available, it was used in hard facing of rotary bits. Tungsten carbide hard facing was used on rotary blade bits and other drag bits and later was used on the gage surfaces of roller cone bits. In addition, tungsten carbide was used first in coating the teeth of milled tooth bits and later in the manufacture of hard inserts for roller bits.

The development of hard facing for drag blade bits extended the life of the bits somewhat but not enough to overcome the need for frequent replacement. Rotary blade bits are customarily used until worn out and then removed from the bore hole. The blades can be cut off from the bit body by a welding torch and a new blade welded in place. This has allowed the bits to be reused but has not overcome the problem of expensive down time for replacing a worn out bit.

In the patent literature:

Pace U.S. Pat. No. 1,351,003 discloses a blade type drag bit having replaceable blades.

Olsen U.S. Pat. No. 2,855,181 discloses a drag bit with stepped cutting edges and hard facing on certain of the wear surfaces.

Weaver U.S. Pat. No. 2,894,726 discloses another drag blade bit having wear inserts.

Christensen U.S. Pat. No. 3,106,973 discloses rotary blade bits having replaceable blades with fine diamond particles embedded in the cutting surfaces.

Bridwell U.S. Pat. No. 3,127,945 discloses a drag blade bit having blades of conventional design provided with diamonds embedded in the cutting and wear surfaces.

The application of finally divided diamonds in wear surfaces of drag bits has been expensive and difficult.

In recent years, there has been developed an improved type of diamond cutter which utilizes synthetic diamonds.

Rowley U.S. Pat. No. 4,073,354 and Rohde U.S. Pat. No. 4,098,363 discloses diamond cutting bits of advanced design. An example of cutting inserts using polycrystalline diamond cutters and an illustration of a drill bit using such cutters is found in Daniels U.S. Pat. No. 4,156,329 and Dennis U.S. Pat. No. 4,323,130.

The most comprehensive treatment of this subject in the literature is probably the chapter entitled STRATAPAX Bits, pages 541–591 in ADVANCED DRILLING TECHNIQUES by William C. Maurer, the Petroleum Publishing Company 1421 South Sheridan Road, P.O. Box 1260, Tulsa, Okla. 74101, published in 1980. This reference illustrates and discusses in detail the development of the STRATAPAX diamond cutting elements by General Electric and gives several examples of commercial drill bits and prototype using such cutting elements. A substantial number of patents and publications have been issued since the publication date of ADVANCED DRILLING TECHNIQUES and so an up-to-date consideration of the prior art must include the recently issued patents.

While the prior art discloses a variety of diamond bits utilizing the STRATAPAX or equivalent diamond cutting elements, this type of diamond cutting element does not seem to have been utilized in producing drag blade bits having extended wear life.

SUMMARY OF THE INVENTION

One object of this invention is to provide a new and improved drag blade bit having diamond insert cutters positioned to provide better wear under high speed drilling conditions.

Another object of this invention is to provide a new and improved drag blade bit having diamond insert cutters along the cutting edges of the cutting blades.

Another object is to provide a drag blade bit having carbide inserts with diamond cutting elements positioned along the cutting edge thereof in a notch which supports the inserts against flexure.

Still another object of this invention is to provide a drag blade bit having cylindrical carbide inserts with disc shaped diamond cutting elements secured thereon positioned in a notch along the blade cutting edge and extending beyond the cutting edge.

Another object is to provide a drag blade bit having carbide inserts with diamond cutting elements positioned along the cutting edge thereof in a notch which supports the inserts against flexure and having the outer end of the cutting edge bevelled with at least one insert positioned on the bevelled portion.

Still another object of this invention is to provide a drag blade bit having cylindrical carbide inserts with disc shaped diamond cutting elements secured thereon positioned in a notch along the blade cutting edge and terminating flush with the cutting edge.

Still another object is to provide an improved drag blade bit having a front to back notch at the outer end of the blades permitting flow of drilling fluid past cutters positioned on the rear of the blades.

Another object of this invention is to provide a new and improved cutting blade with diamond insert cutters in the cutting edge thereof for use in drag blade bits.

Another object is to provide a drag bit blade having carbide inserts with diamond cutting elements positioned along the cutting edge thereof in a notch which supports the inserts against flexure.

Still another object of this invention is to provide a drag bit blade having cylindrical carbide inserts with disc shaped diamond cutting elements secured thereon positioned in a notch along the blade cutting edge and extending beyond the cutting edge.

Another object is to provide a drag bit blade having carbide inserts with diamond cutting elements positioned along the cutting edge thereof in a notch which supports the inserts against flexure and having the outer end of the cutting edge bevelled with at least one insert positioned on the bevelled portion.

Still another object of this invention is to provide a drag bit blade having cylindrical carbide inserts with disc shaped diamond cutting elements secured thereon positioned in a notch along the blade cutting edge and terminating flush with the cutting edge.

Still another object is to provide an improved drag bit blade having a front to back notch at the outer end of the blades permitting flow of drilling fluid past cutters positioned on the rear of the blades.

Other objects and features of this invention will become apparent from time to time throughout the specification and claims as hereinafter related.

These objectives are accomplished by a new and improved drag blade bit as described herein. A drag blade bit for connection on a drill string has a hollow body on which there are welded a plurality of cutting or drilling blades. The blades extend longitudinally and radially of the bit body and terminate in flat, radially extending cutting edges. A plurality of cutters are positioned in and spaced along the cutting edges and consists of cylindrical sintered carbide inserts with polycrystalline diamond cutting elements mounted thereon. Hardfacing is provided on the cutting edges between the cutters and on the other surfaces of the blades and the bit body subject to abrasive wear. One or more nozzles are positioned in passages from the interior of the bit body for directing flow of drilling fluid for flushing cuttings from the well bore and for cooling the bit.

DESCRIPTION OF THE PREFERRED EMBODIMENTS

Figure 1:
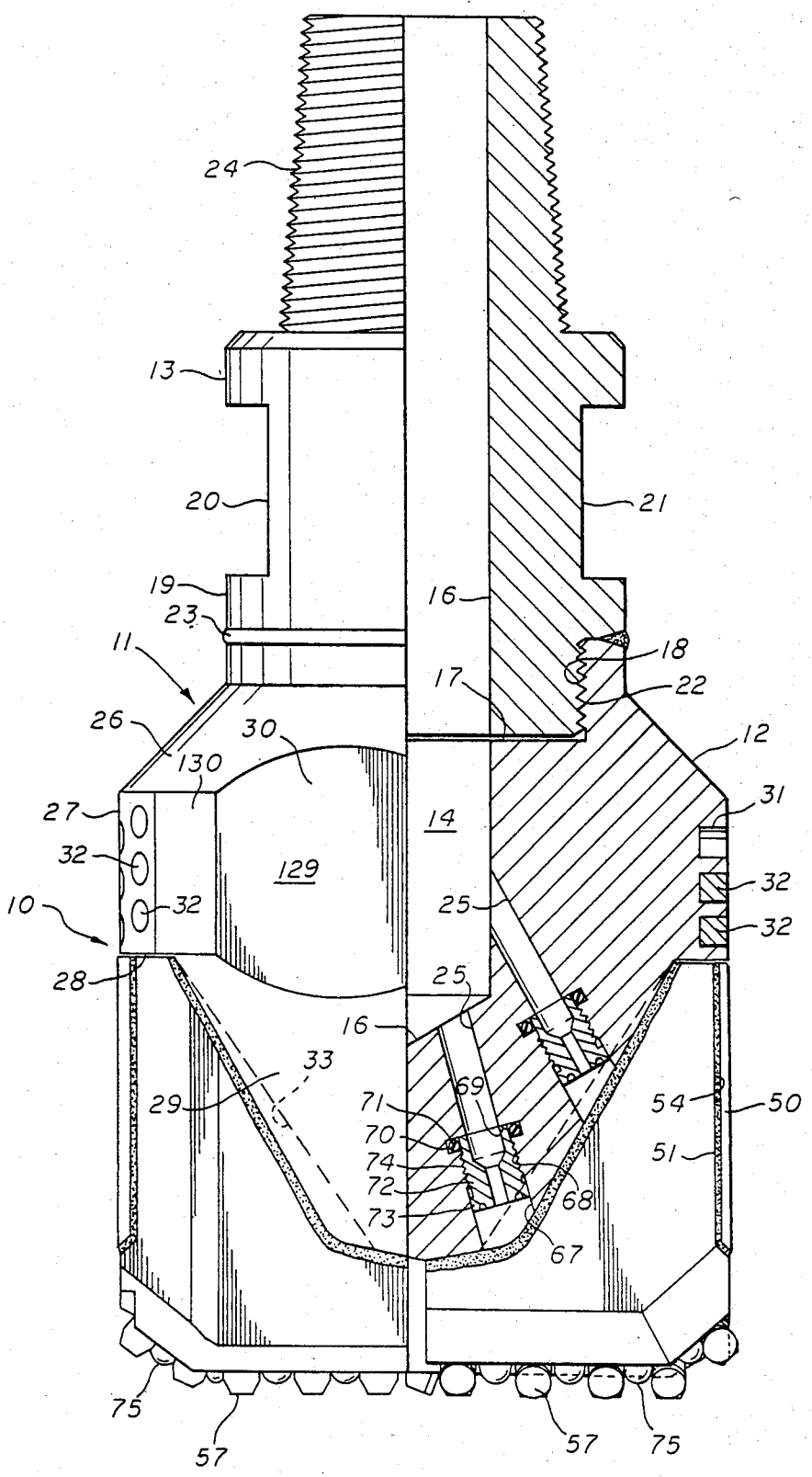
FIG. 1 is a view in quarter section, on the line 1—1 of FIG. 2, of a drag blade bit comprising a preferred embodiment of this invention.
Figure 2:
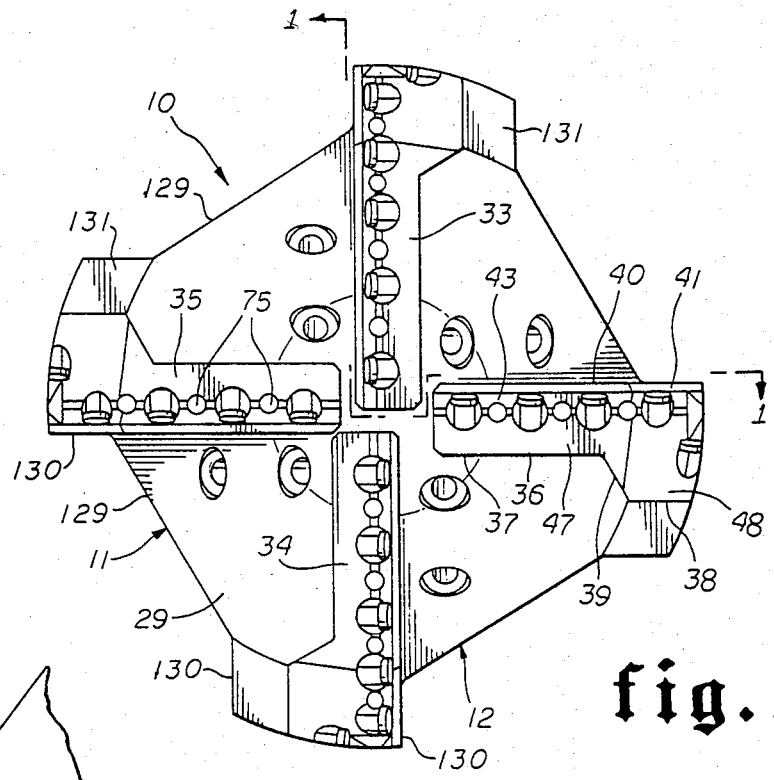
FIG. 2 is a view in bottom end elevation of the drag blade bit shown in FIG. 1.

Referring to the drawings by numerals of reference, and more particularly to FIGS. 1 and 2, there is shown a drag blade bit 10 having a bit body 11 consisting of bit head 12 and threaded sub 13. The bit body 11 is cast and machined from a high temperature steel alloy. Bit head 12 has an internal cavity 14 defined by passage 15 and end wall 16. Cavity 14 is therefore closed at one end and open at the other end where it communicates with longitudinal passage 16 in connection sub 13. The open end portion of bit head 12 has a counterbore 17 which is internally threaded as indicated at 18.

Connection sub 13 has a cylindrical outer surface 19 provided with slots 20 and 21 for receiving tongs or wrenches or the like. The lower end of connection sub 13 is of reduced diameter and threaded as indicated at 22 where it is threadedly secured in the threaded opening 18 in bit head 12. When the connection sub 13 is threadedly secured in place it is welded as indicated at 23 to bit head 12 to produce a unitary bit body 11. The other end of connection sub 13 is provided with a tapered threaded portion 24 for connection to a drill collar.

Bit body 11 has a plurality (preferably eight) of passages 25 opening from interior cavity 14 through end wall 16 for flow of drilling fluid used for flushing cuttings from the well bore and cooling the cutting surfaces of the bit. The exterior surface of the bit head 12 comprises a bevel or conical surface 26 leading to a cylindrical peripheral surface 27 terminating in a peripheral shoulder 28 from which there extends a tapered or conical end portion 29.

A plurality of large surface grooves or junk slots 30 extend through the cylindrical outer surface 27 at spaced intervals around the periphery thereof. Junk slots 30 have a flat back wall 129 and tapered flat side walls 130. Junk slots 30 provide for passage of drilling fluid and cuttings from the well bore away from the cutting area. Junk slots 30 divide the peripheral surface 27 into a plurality of separate shoulders 131. Cylindrical surface 27 has a plurality of recesses 31 (FIG. 1) in which there are positioned inserts 32 of sintered tungsten carbide or equivalent hard facing material. The conical end portion 29 of bit head 12 has a, plurality of slots 33 equally spaced and corresponding in number to the blades to be inserted in the bit.

Figure 3A:
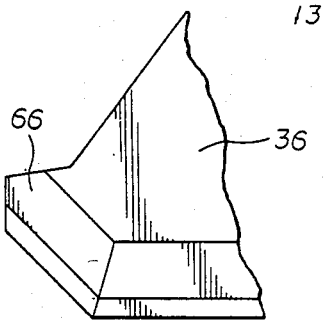
FIG. 3A is a fragmentary view in elevation showing an alternate embodiment of the bid blade of FIG. 3.
Figure 3:
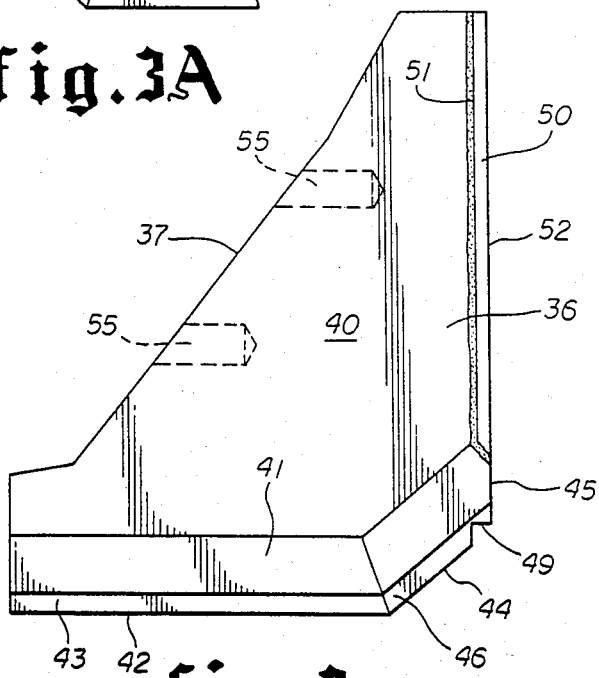
FIG. 3 is a view in elevation of one bit blade of the bit shown in FIGS. 1 and 2.
Figure 4:
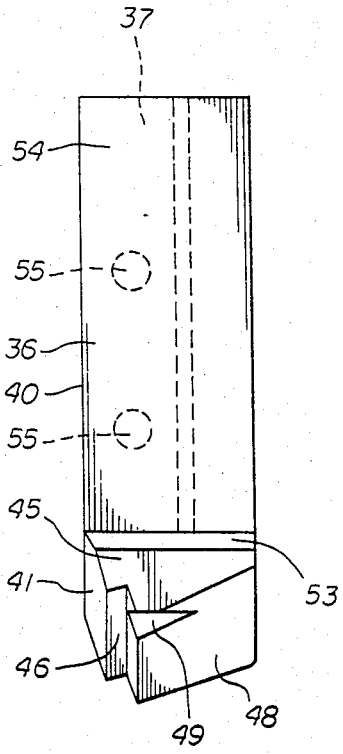
FIG. 4 is a view in right end elevation of the bit blade of FIG. 3.
Figure 5:
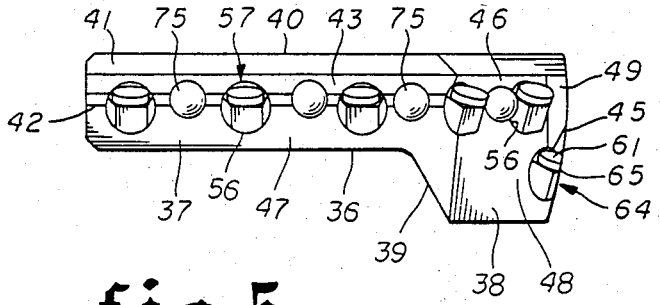
FIG. 5 is a view in bottom end elevation of the bit blade of FIG. 3.
Figure 6:
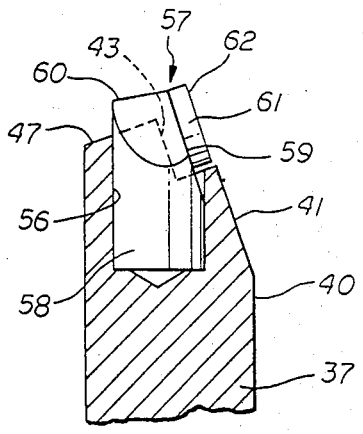
FIG. 6 is a view in vertical section through the bit blade showing the positioning of the cutter inserts.

The bottom face of blade bit 10 is shown in FIG. 2. In this view, a plurality of blade members are secured on conical end portion 29 of bit head 12. Two of the blade members 33 and 34 extend almost to the center line of the bit. The other blade members 35 and 36 are slightly shorter. Blade members 35 and 36 are substantially the same as blade members 33 and 34 except for their shortened length and that they have each one less cutter element. Details of blade member 36 are shown in FIGS. 3, 4 and 5.

Blade member 36 has a narrower flat blade portion 37 and wide end portion 38 joined by a bevelled shoulder 39. The front face 40 of blade member 36 has a bevelled surface 41 extending along the outer edge or cutting edge portion 42. A groove 43 extends along the length of cutting edge 42. At the outer or peripheral portion of blade member 36 the cutting edge is bevelled as at 44 extending out to the outer peripheral surface 45. The groove 43 continues as an inclined groove 46 following the bevel 44 toward the outer peripheral surface 45. At the cutting edge 42 of blade member 36 there is a rearwardly extending bevelled surface 47 which joins and merges into bevelled surface 48 on the wide end portion 38. A notch 49 extends from front to back as shown in FIGS. 3 and 4, to provide for flow of drilling fluid between the front and back faces of the blade members.

A flat strip of hard facing 50 is welded to the outer face of blade member 36 as indicated at 51. The outer surface 52 of hard facing 50 is a continuation of peripheral surface 45. In FIG. 4, the hard facing is omitted to show the bevel 53 leading to the recessed surface 54 onto which the hard facing 50 is welded. The hard facing material 50 is preferably sintered tungsten carbide, although other conventional hard facing materials made as pads which may be welded in place could be used.

While the hard facing 50 is shown as a separate piece welded in place, it is also possible to cast the hard facing as an integral piece with the blade members at the time they are cast or molded. It is also possible to hard face the blade members by conventional hard facing techniques known to the prior art and particularly the process of plasma spraying of hard facing material which has recently developed.

The narrower portion 37 of blade member 36 has a pair of recesses 55 which receive dowels for holding the blade member in place during welding to the bit body. When blade member 36 is positioned on bit head 12 it is positioned in one slot 33 with dowels (not shown) fitting into recesses in the bit head and recesses 55 in the blade member. This holds the blade members in a selected, fixed position during welding of the blade member to the bit head.

A plurality of recesses 56 are drilled in the cutting edge portions 42 and 44 in notches 43 and 46 to receive diamond cutters 57. Cutters 57 may be of the STRATAPAX type manufactured by General Electric Company or may be equivalent cutters made by other suppliers. STRATAPAX cutters are described in Daniels U.S. Pat. No. 4,156,329, Rowley U.S. Pat. No. 4,073,354 and in considerable detail in the book ADVANCED DRILLING TECHNIQUES by William C. Maurer.

Diamond cutters 57 consist of a cylindrical supporting stud 58 of sintered carbide. Stud 58 has an angled surface 59 which is tapered at the same angle as bevelled surface 41. The top of stud 58 is tapered to the back as indicated at 60. A disc shaped cutting element 61 is bonded on angled surface 59, preferably by brazing or the like. Disc shaped cutting element 61 is a sintered carbide disc having a cutting surface 62 comprising polycrystalline diamond.

Figure 7:
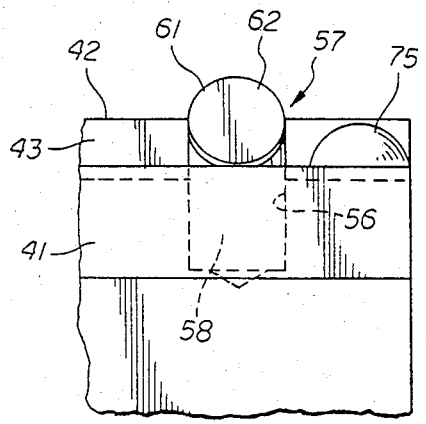
FIG. 7 is a detail view in elevation of the edge of the bit blade showing the positioning of the cutter insert in the edge notch.

In FIG. 7, it is seen that cutting element 57 has stud 58 positioned in recess 56 so that cutter disc 61 abuts the bottom edge of notch 43 while the back edge of notch 43 provides added support for the stud 58 against flexure. Beads or globules 75 of hard facing material are welded to the cutting edge portion 42 of the blade members between the cutters 57 to provide added wear protection. This hard facing, together with the hard facing layer 50, protects the blade members against wear during drilling operation.

Figure 8:
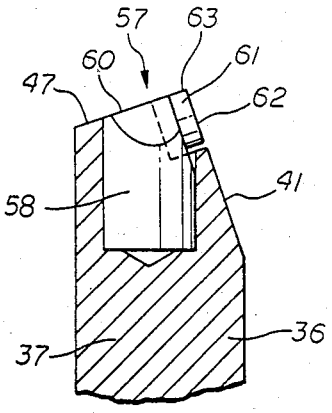
FIG. 8 is a view in section similar to FIG. 6, showing an alternate embodiment of the cutter inserts.
Figure 9:
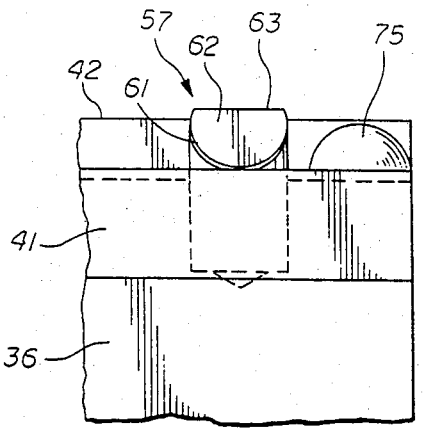
FIG. 9 is a detail edge view of the blade and insert cutter of FIG. 8.

In FIGS. 8 and 9 there is shown an alternate embodiment of the cutters 57. In this embodiment, cutter disc 61 is cut off along chord line 63 which is flush with end surface 60 of stud member 58 and is also flush with the bevelled surface 47 of the cutting edge portion of the blade member. This arrangement partially recesses the cutting element so that the chord edge 63 represents the cutting surface which is available for cutting with a scraping action. The cutting edge 63 extends only slightly beyond the edge portion 42 of blade member 36.

The outermost and rearmost cutter 64 has the cutter disc cut along an edge 65 which provides a flat cutting surface which is a continuation of the peripheral edge surface 45 of blade member 36. Cutter 64 is a gage cutter which extends only slightly beyond the gage surface of the blade member.

Figure 10:
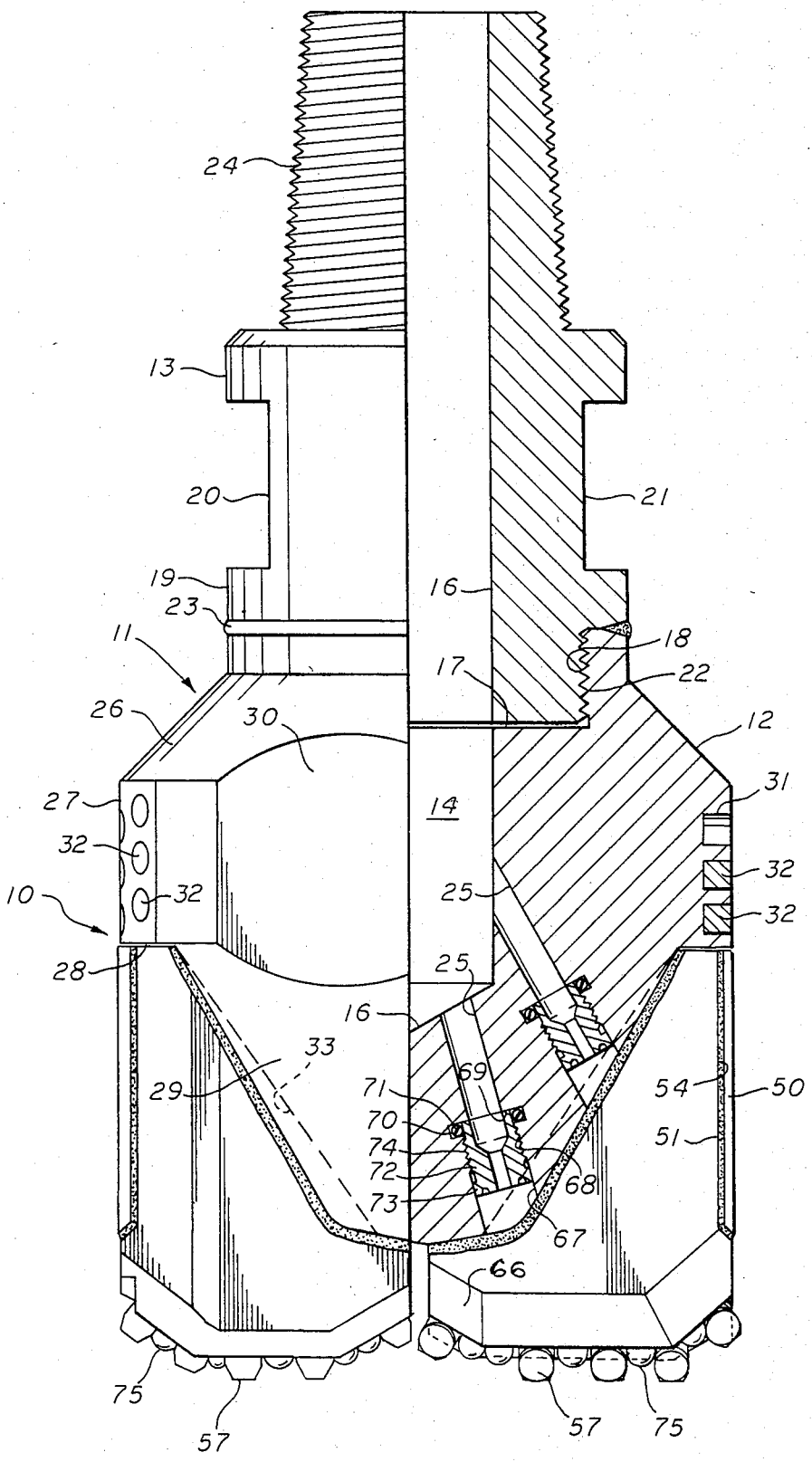
FIG. 10 is a view in quarter section, similar to FIG. 1, of an alternate embodiment of the drag blade bit using the blade shown in FIG. 3A.

In FIG. 10 there is shown an alternate embodiment of the invention in which blade member 36 has an inner bevelled portion 66 which has about the same bevel as the outer bevelled portion 44. Notch 43 continues into the bevelled portion 66. In this embodiment, one diamond cutter 57 is positioned in bevelled portion 66. A detail of blade member 36 showing this embodiment is shown in FIG. 3A. Embodiment shown in FIG. 10 is otherwise the same as that shown in the other Figures and the same reference numerals are used.

In both the embodiments of FIGS. 1 and 10, passages 25 open outwardly through end wall 16 of bit head 12 for discharging drilling fluid adjacent to the blade members. Passages 25 are designed to receive replaceable nozzles of any suitable, commercially available design. The nozzles are preferably constructed according to U.S. Pat. No. 4,381,825, co-pending with this application.

Nozzle passages 25 are counterbored at their outer ends to a slightly large diameter as indicated at 67. There is an intermediate portion of slightly smaller diameter which is threaded as indicated at 68 and terminates in a shoulder 69 adjacent to passage 25. A peripheral groove 70 surrounds the nozzle passage adjacent to shoulder 69 and receives a sealing O-ring 71. Nozzle member 72 is formed of tungsten carbide and has a flange 73 which fits snugly in counterbore 67. Nozzle member 72 has a portion of reduced diameter behind flange 73 on which there is positioned a sleeve (not shown) in which there are formed threads 74 which allow for the nozzle to be secured in the passage thread 68.

Details of this nozzle member are shown in U.S. Pat. No. 4,381,825. The nozzle members 72 are easily installed and replaced for either field or factory service. The innermost end of the nozzle member 72 abuts against shoulder 69 and is sealed by O-ring 71. If desired, a sealing ring may be pressed fitted against the nozzle member 72 to resist any tendency of the nozzle member to become unscrewed. A sealing ring of this type also provides some protection against wash out of metal on the edges of the counterbore 67.

OPERATION

The operation of this drag blade bit should be apparent from the description of its component parts and method of assembly. Nevertheless, it is useful to restate the operating characteristics of this novel drag blade bit to make its novel features and advantages clear and understandable.

The drag blade bit 10 as shown in the drawings and described above is connected to a drill string for drilling operation. The threaded portion 24 of the connection sub 13 is threadedly connected in a drill collar. The drill string is rotated in a conventional manner and drilling fluid (drilling mud) is circulated through the drill string into bit cavity and out through passages 25 and nozzle members 72.

The rotation of drag blade bit 10 by the drill string, accompanied by circulation of drilling fluid, causes the bit to drill rapidly through clay, gumbo, shale and other soft formations in which blade bits are used. The diamond cutters 57 are effective to cut and scrape through the softer formations and can even cut through some rock formations in which conventional blade bits cannot be used. The hard facing 50 on the gage surface of the blade members and the hard facing beads 75 on the blade member cutting edges 42 prevent excessive wear on the blade members.

The drag blade bits of this design have an operating life many times that of conventional hard faced blade bits and even longer than blade bits faced with fine diamond particles. The cutting or drilling efficiency of the bit is enhanced by the placement of the diamond cutters 57 along the cutting edge 42 and particularly the placement of cutter 64 toward the rear face of the blade member. This rearward positioning of cutter 64 is possible because of the provision of notch 49 which permits drilling fluid to flow to that cutter for improved washing and cooling action.

While this invention has been described with special emphasis on certain preferred embodiments, it should be understood that within the scope of the appended claims the invention may be practiced otherwise than as specifically shown and described herein.

We claim:

1. A cutting element for a drag blade bit having a hollow metal bit body open at one end for connection to a drill string and closed at the other end, said cutting element comprising a metal blade member adapted to be welded to said bit body in a position having forwardly and radially extending cutting edges and longitudinally extending gage edges comprising wear surfaces, said blade member having a plurality of recesses spaced along said cutting edge, a plurality of cutters positioned one in each of said recesses, said cutters each comprising a cylindrical supporting stud of sintered carbide having an angularly oriented supporting surface with a disc-shaped element bonded thereon comprising a sintered carbide disc having a cutting surface comprising polycrystalline diamond;

said blade member cutting edge includes a bevelled surface at substantially the same angle of bevel as the angled surface of said cylindrical supporting stud, and said cutters are positioned in said recesses at a depth such that the flat surfaces of said cutting discs lie in substantially the same inclined plane as said bevelled surface.

2. A cutting element according to claim 1 in which said blade member has hard facing material secured on the wear surfaces thereof.

3. A cutting element according to claim 1 in which said hard facing material comprises separate masses of hard facing composition welded to said cutting edges between said cutters.

4. A cutting element according to claim 1 in which said hard facing material comprises layers of hard-facing composition welded to and covering said gage edges.

5. A cutting element according to claim 1 in which said hard facing material is cast into the wear surfaces of said blade members during the casting or molding thereof.

6. A cutting element according to claim 1 in which said blade member comprises a plate shaped member having an inner edge contoured to fit the surface of said bit body for welding thereto with said cutting edge positioned radially of said bit body closed end and said gage edge extending longitudinally of the outer peripheral surface of said bit body, said cutting edge having a notch extending substantially the entire length thereof, said edge recesses being positioned in said edge notch, and said cutters having said cylindrical inserts positioned in said recesses with said cutting discs extending above the bottom of said notches with the back wall of each notch supporting each cutter against flexure.

7. A cutting element according to claim 6 in which said cutting discs extend beyond said cutting edge.

8. A cutting element according to claim 6 in which said cutting discs each have a flat chord edge positioned flush with said cutting edge.

9. A cutting element according to claim 6 in which each of said cutting edges has an outer end portion bevelled in relation to the longitudinal axis of said bit body, said notch extends along said bevelled end portion, and at least one of said cutters is positioned in said notch on said bevelled end portion.

10. A cutting element according to claim 6 in which said blade member outer end has a notch extending from said first named notch toward the opposite side thereof to permit flow of drilling fluid from one side of said cutting edge to the other during drilling operation, and at least one of said cutters is positioned on the rear of said cutting edge to receive drilling fluid flowing through said outer end notch.

11. A cutting element for a drag blade bit having a hollow metal bit body open at one end for connection to a drill string and closed at the other end, said cutting element comprising a metal blade member adapted to be welded to said bit body in a position having forwardly and radially extending cutting edges and longitudinally extending gage edges comprising wear surfaces, said blade member having a plurality of recesses spaced along said cutting edge, a plurality of cutters positioned one in each of said recesses, said cutters each comprising a cylindrical supporting stud of sintered carbide having an angularly oriented supporting surface with a disc-shaped element bonded thereon comprising a sintered carbide disc having a cutting surface comprising polycrystalline diamond, said blade member comprises a plate-shaped member having an inner edge contoured to fit the surface of said bit body for welding thereto with said cutting edge positioned radially of said bit body closed end and said gage edge extending longitudinally of the outer peripheral surface of said bit body, said cutting edge having a notch extending substantially the entire length thereof, said edge recesses being positioned in said edge notch, and said cutters having said cylindrical inserts positioned in said recesses with said cutting discs extending above the bottom of said notches with the back wall of each notch supporting each cutter against flexure, said blade member cutting edge includes a beveled surface at the same angle of bevel as the angled surface of said cylindrical supporting stud, and said cutters are positioned in said recesses at a depth such that the flat surfaces of said cutting discs lie in substantially the same inclined plane as said beveled surface.

12. A cutting element according to claim 11, in which:

each of said cutting edges has an outer end portion beveled in relation to the longitudinal axis of said bit body, said notch extends along said beveled end portion, and at least one of said cutters is positioned in said notch on said beveled end portion.

13. A cutting element for a drag blade bit having a hollow metal bit body open at one end for connection to a drill string and closed at the other end, said cutting element comprising a metal blade member adapted to be welded to said bit body in a position having forwardly and radially extending cutting edges and longitudinally extending gage edges comprising wear surfaces, said blade member having a plurality of recesses spaced along said cutting edge, a plurality of cutters positioned one in each of said recesses, said cutters each comprising a cylindrical supporting stud of sintered carbide having an angularly oriented supporting surface with a disc-shaped element bonded thereon comprising a sintered carbide disc having a cutting surface comprising polycrystalline diamond, said blade member comprises a plate-shaped member having an inner edge contoured to fit the surface of said bit body for welding thereto with said cutting edge positioned radially of said bit body closed end and said gage edge extending longitudinally of the outer peripheral surface of said bit body, said cutting edge having a notch extending substantially the entire length thereof, said edge recesses being positioned in said edge notch, and said cutters having said cylindrical inserts positioned in said recesses with said cutting discs extending above the bottom of said notches with the back wall of each notch supporting each cutter against flexure, each of said cutting edges has an outer end portion beveled in relation to the longitudinal axis of said bit body, said notch extends along said beveled end portion, and at least one of said cutters is positioned in said notch on said beveled end portion.

14. A cutting element in combination with a drag blade bit having a hollow metal bit body open at one end for connection to a drill string and closed at the other end, said cutting element comprising a metal blade member adapted to be welded to said bit body in a position having forwardly and radially extending cutting edges and longitudinally extending gage edges comprising wear surfaces, said blade member having a plurality of recesses spaced along said cutting edge, a plurality of cutters positioned one in each of said recesses, said cutters each comprising a cylindrical supporting stud of sintered carbide having an angularly oriented supporting surface with a disc-shaped element bonded thereon comprising a sintered carbide disc having a cutting surface comprising polycrystalline diamond;

said blade member cutting edge includes a beveled surface at substantially the same angle of bevel as the angled surface of said cylindrical supporting stud, and said cutters are positioned in said recesses at a depth such that the flat surfaces of said cutting discs lie in substantially the same inclined plane as said beveled surface.

15. A cutting element in combination with a drag blade bit having a hollow metal bit body open at one end for connection to a drill string and closed at the other end, said cutting element comprising a metal blade member adapted to be welded to said bit body in a position having forwardly and radially extending cutting edges and longitudinally extending gage edges comprising wear surfaces, said blade member having a plurality of recesses spaced along said cutting edge, a plurality of cutters positioned one in each of said recesses, said cutters each comprising a cylindrical supporting stud of sintered carbide having an angularly oriented supporting surface with a disc-shaped element bonded thereon comprising a sintered carbide disc having a cutting surface comprising polycrystalline diamond, said blade member comprises a plate-shaped member having an inner edge contoured to fit the surface of said bit body for welding thereto with said cutting edge positioned radially of said bit body closed end and said gage edge extending longitudinally of the outer peripheral surface of said bit body, said cutting edge having a notch extending substantially the entire length thereof, said edge recesses being positioned in said edge notch, and said cutters having said cylindrical inserts positioned in said recesses with said cutting discs extending above the bottom of said notches with the back wall of each notch supporting each cutter against flexure, each of said cutting edges has an outer end portion beveled in relation to the longitudinal axis of said bit body, said notch extends along said beveled end portion, and at least one of said cutters is positioned in said notch on said beveled edge portion.

* * * * *